United States Patent [19]

Johnson, Jr.

[11] Patent Number: 4,478,006

[45] Date of Patent: Oct. 23, 1984

[54] SLIDING DOOR FRAME CORNER LOCK

[75] Inventor: Leonard E. Johnson, Jr., Elkhart, Ind.

[73] Assignee: L. E. Johnson, Inc., Elkhart, Ind.

[21] Appl. No.: 522,469

[22] Filed: Aug. 11, 1983

[51] Int. Cl.[3] ..... E05D 13/02

[52] U.S. Cl. ..... 49/410; 16/105; 403/231; 403/322

[58] Field of Search ..... 49/425, 409, 410, 411; 16/105; 403/231, 322

[56] References Cited

U.S. PATENT DOCUMENTS

| | | | |
|---|---|---|---|
| 2,994,414 | 8/1961 | Gebhard | 403/231 X |
| 3,141,189 | 7/1964 | Fergison | 16/105 |
| 3,261,129 | 7/1966 | Brydolf et al. | 49/411 |
| 3,744,827 | 7/1973 | Cox | 49/411 |
| 4,288,887 | 9/1981 | Johnson et al. | 49/409 X |

*Primary Examiner*—Kenneth Downey

*Attorney, Agent, or Firm*—James D. Hall

[57] ABSTRACT

A lock for rail and stile members of a sliding door frame. The lock includes an actuator and an associated slide member, each having protrusions which can be extended into the door frame members when the actuator is moved into a lock position.

8 Claims, 9 Drawing Figures

SLIDING DOOR FRAME CORNER LOCK

SUMMARY OF THE INVENTION

This invention relates to a sliding door assembly and will have special application to a corner lock for the frame or rail and stile members of the assembly.

The frame corner lock of this invention serves to provide a fast, efficient means for connecting the abutting frame members of a sliding door. The lock includes a latch member associated with a camming mechanism. The latch member is placed in a corner of the door assembly frame and the camming mechanism is activated to cause latching extensions to engage the juxtaposed frame members. The corner lock may carry a roller or guide for the door assembly.

Accordingly, it is an object of this invention to provide a novel frame lock mechanism which is for a sliding door.

Another object of this invention is to provide a frame lock which is for a sliding door and which allows the lock to be rapidly assembled upon and disassembled from the door frame by hand.

Another object of this invention is to provide for a corner frame lock which is for a sliding door and which is efficient and economical.

Other objects will become apparent upon a reading of the following description.

BRIEF DESCRIPTION OF THE DRAWINGS

A preferred embodiment of the invention has been chosen to illustrate the principles thereof wherein.

DESCRIPTION OF THE PREFERRED EMBODIMENT

Figure 1:
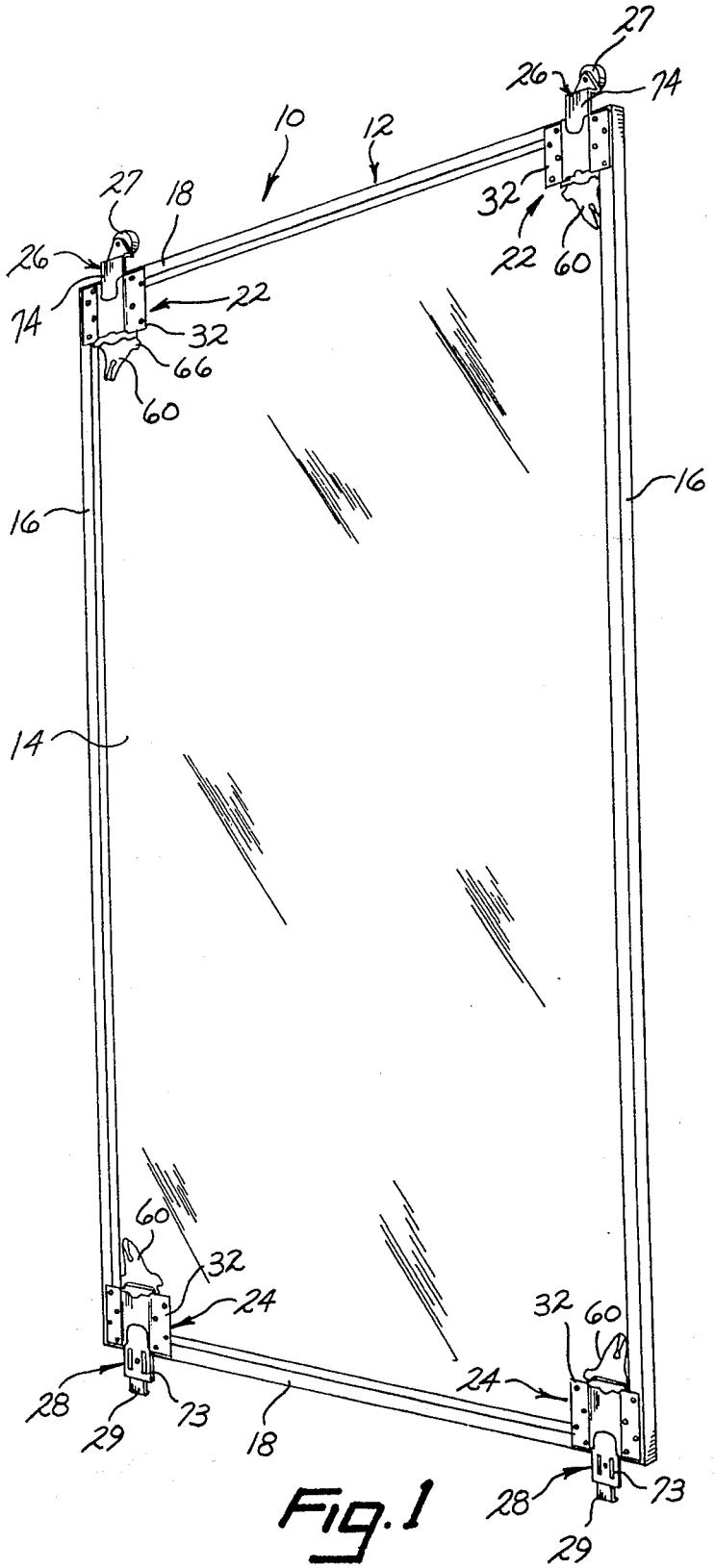
FIG. 1 is a perspective view of a sliding door assembly using the frame lock of this invention.

The preferred embodiment herein described is not intended to be exhaustive or to limit the invention to the precise form disclosed. It is chosen and described to best explain the principles of the invention and its application and practical use to thereby enable others skilled in the art to utilize the invention.

The sliding door assembly 10 depicted in the drawings includes a frame 12 which encloses and secures a panel 14 about the panel's periphery. Frame 12 includes individual right angular adjoining frame members 16, 18 (stiles and rails) and is adapted to be fitted within a door opening and supported upon guide tracks (not shown). Each frame member 16,18 is box-shaped in cross-section and has a slotted opening 17 at one side to accommodate panel member 14. Frame locks 22,24 are positioned at each corner of frame 12. Each upper lock 22 includes a hanger 26 which slides across an upper guide track. Each bottom lock 24 includes a guide 28 which slides within a lower guide track.

Figure 8:
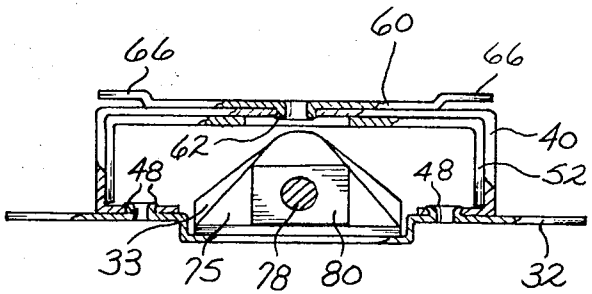
FIG. 8 is a cross sectional view taken along line 8—8 of FIG. 2.

Each lock 22,24 includes a plate 32. Plate 32 includes a lower forwardly extending lip 33 having an opening 35. Plate 32 also includes forwardly extending projections 36 which fit into a plurality of holes 34 formed in frame members 16,18. Each lock 22,24 includes a base 40. Base 40 is generally C-shaped in cross-section and includes a pair of opposed lip parts 42. A channel 44 is formed in base 40 between its front wall 41 and lip parts 42. Base 40 is secured to plate 32 at its lip parts 42, such as by the flared punched connections 48 shown in FIG. 8. A slot 50 is formed in base front wall 41.

Figure 7:
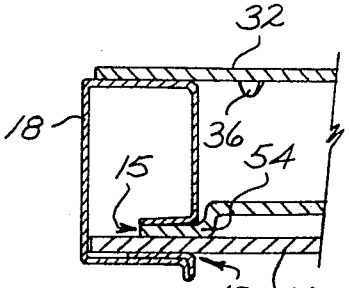
FIG. 7 is a cross sectional view taken along line 7—7 of FIG. 3.

A slide 52 is fitted with sliding clearance within channel 44 of base 40. Slide 52 includes a pair of forwardly offset lock tabs 54 extending from one end edge 51 of the slide. Lock tabs 54 fit into the gap 15 between frame member 18 and panel 14 within slot 17, as seen in FIG. 7, when slide 52 is shifted away from plate lip 33 within base channel 44. Slide 52 has a V-shaped slot 58 formed near its end edge 53.

Figure 3:
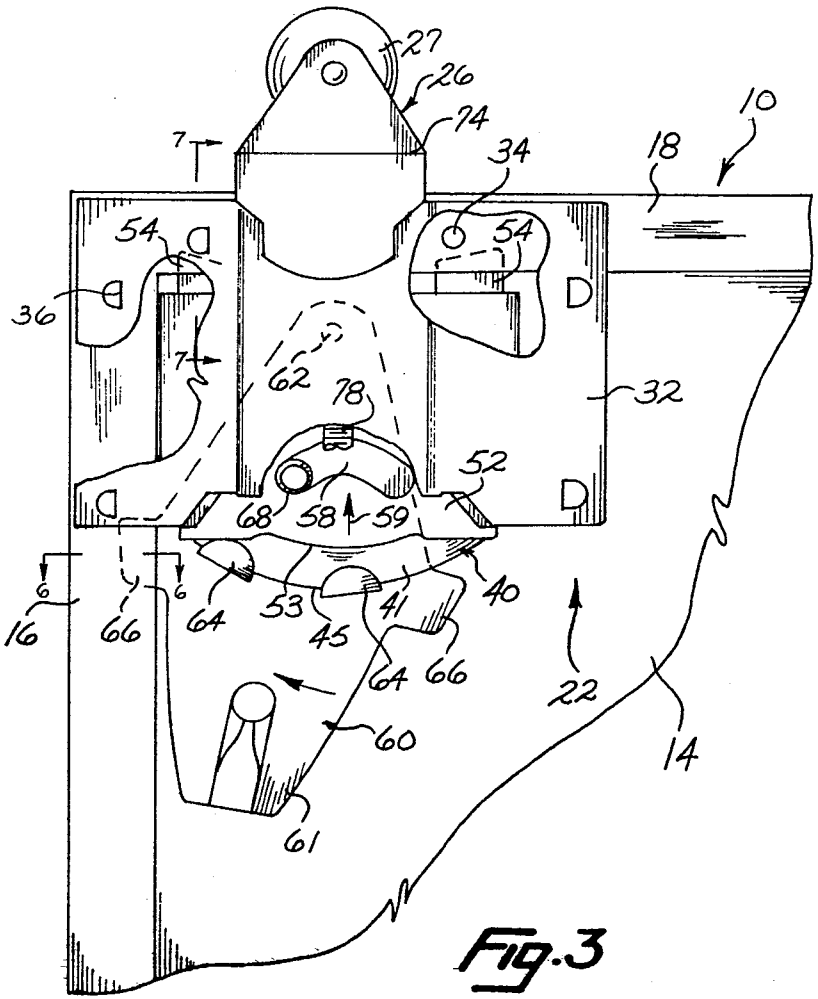
FIG. 3 is a view similar to FIG. 2, but showing the frame lock in its locked position.
Figure 6:
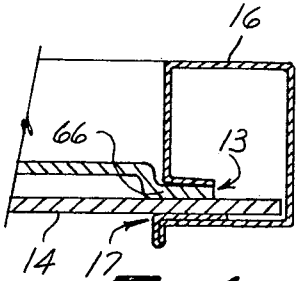
FIG. 6 is a cross sectional view taken along line 6—6 of FIG. 3.

Each lock 22,24 also includes a camming actuator 60, which is pivotally mounted to the exterior side of base front wall 41, such as by a single flared punched connection 62. Actuator 60 includes a pair of raised camming tabs 64 which fit around arcuate edge 45 of the front wall 41 of base 40. A pair of lock tabs 66 extend laterally from opposite sides of actuator 60. As actuator 60 is pivoted upon base 40, one of the lock tabs 66 projects into the the gap 13 between frame member 16 and panel 14 within slot 17 as seen in FIG. 6. Also, when actuator 60 is so pivoted, a camming tab 64 contacts slide member end edge 53, which acts as a cam follower, and urges slide member 52 away from plate lip 33 as shown by arrow 59 in FIG. 3. A stop, such as a raised punch 68, extends from actuator 60 throughout slot 50 in base 40 and into V-slot 58 to restrict the amount of pivoting movement of the actuator relative to base 40 and to shiftably interlock slide 52 within the base.

The frame locks 22, 24 illustrated also include either a hanger 26 having a roller 27 or a guide 28 having an insert 29. Each hanger 26 and guide 28 includes a bracket which is slidably located between slide 52 and plate 32. Hanger bracket 74 includes a lip 75 having an opening 76 which is aligned with opening 35 in plate lip 33. An adjustment screw 78 extends freely through lip openings 35 and 76 and is threaded into a nut 80 which acts as a stop for bracket 74. The amount screw 78 is turned into nut 80 determines the selected spacing between plate lip 33 and bracket lip 75 and the vertical position of the bracket 74 relative to plate 32. Guide bracket 73 includes a leg (not shown) which extends through opening 35 in plate lip 33 and which terminates in a foot (not shown) used to permit withdrawal of the leg from the plate lip during use of guide 28.

Figure 2:
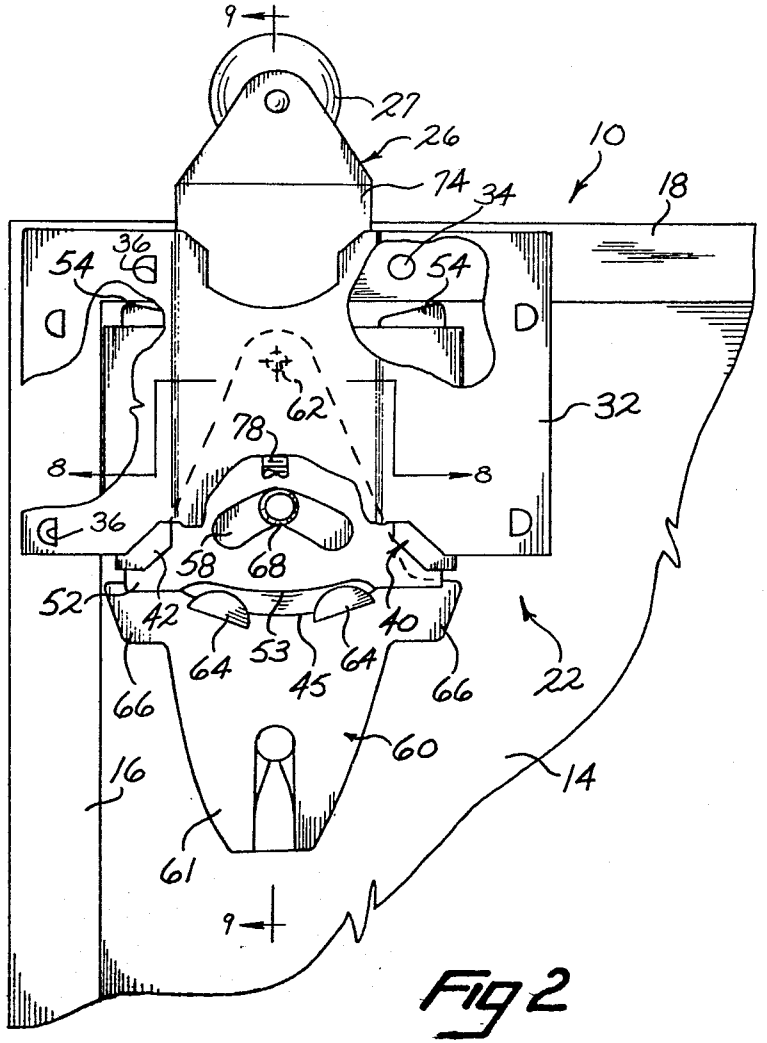
FIG. 2 is a fragmentary face view of a frame lock shown in its unlocked position.
Figure 4:
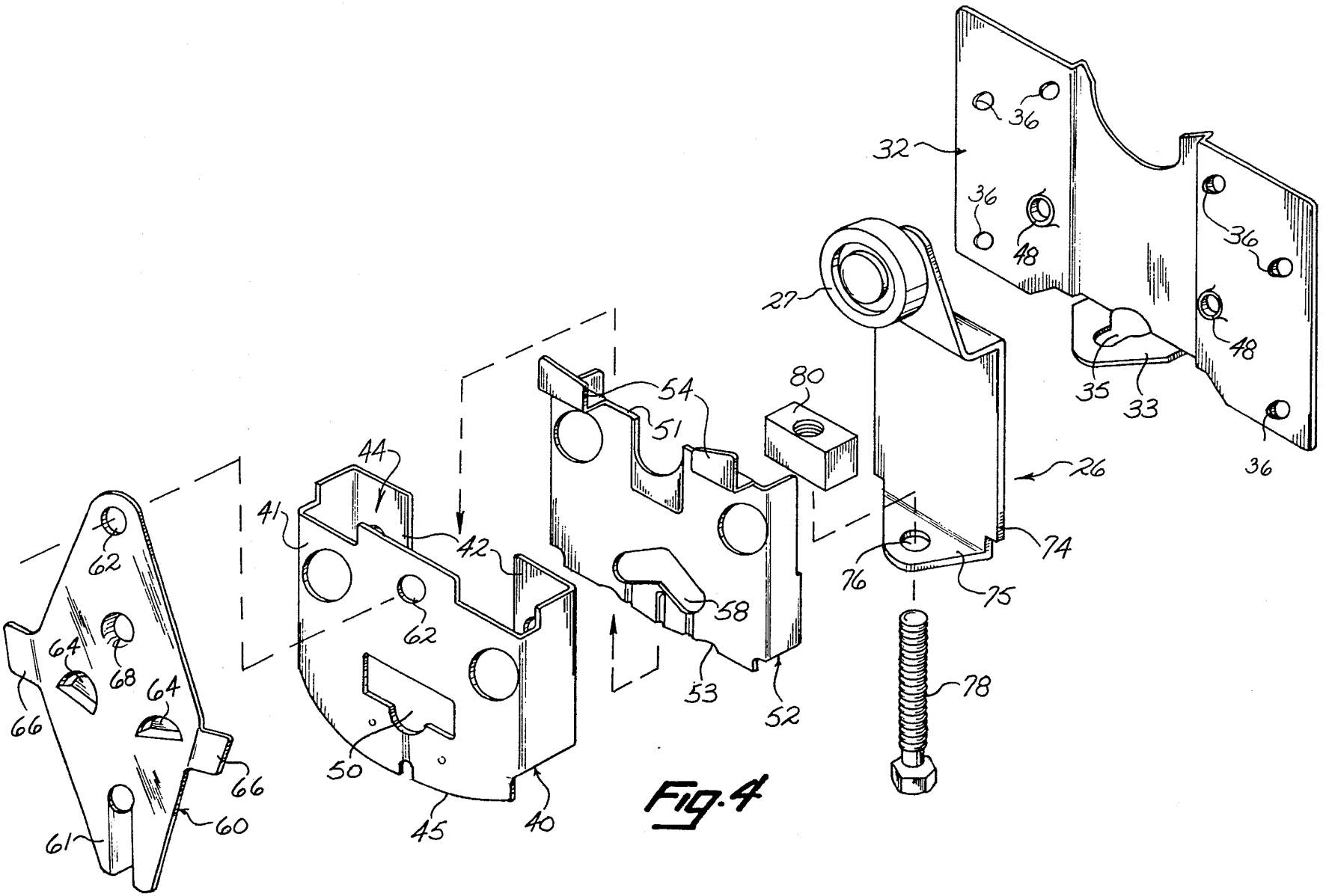
FIG. 4 is an exploded view of the components of the frame lock.
Figure 5:
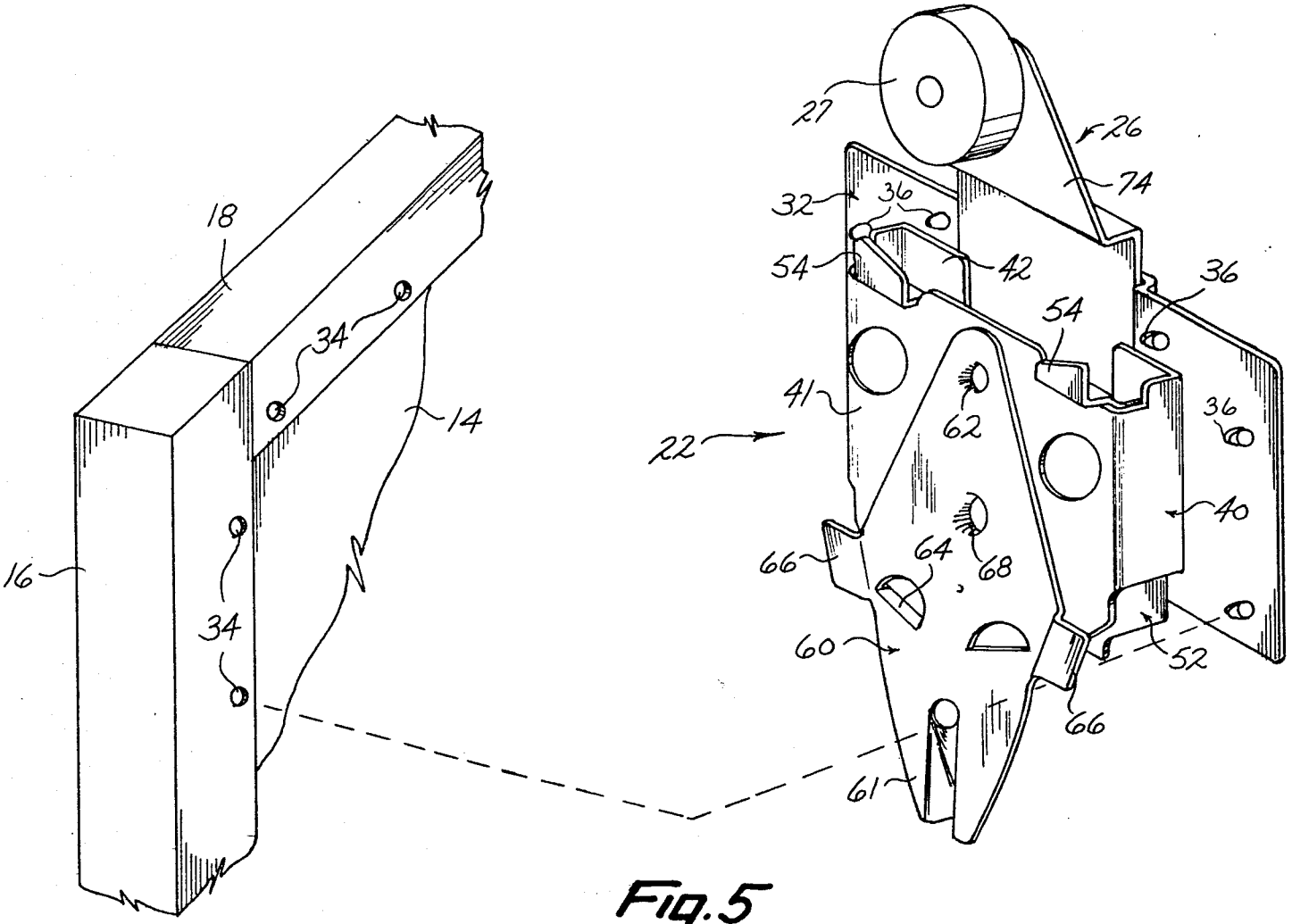
FIG. 5 is a fragmentary perspective view of a door frame corner and the frame locked detached.
Figure 9:
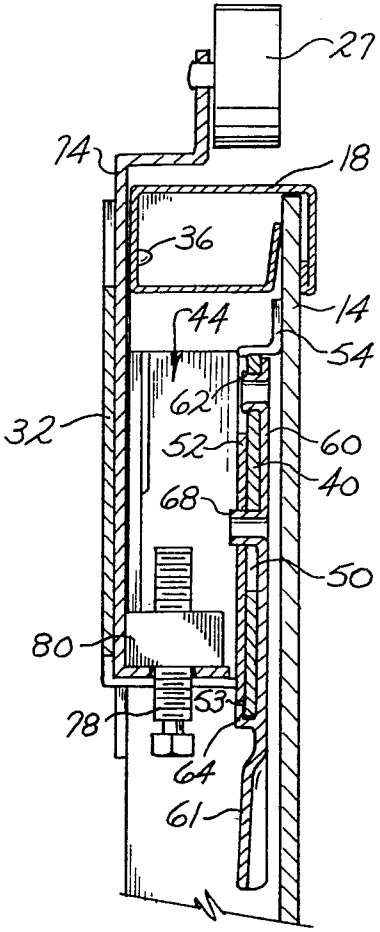
FIG. 9 is a longitudinal sectional view taken along line 9—9 of FIG. 2.

Frame lock 22, 24 is installed as follows. With actuator 60 in its centered or release position as shown in FIG. 2, the lock is moved to a corner of frame 12. Plate 32 of the lock is caused to overlap frame members 16, 18 at two of its marginal edges with its projections 36 along such marginal edges entering holes 34 in the frame members. Base 40 of the lock is located within the interior of frame 12, adjacently overlying panel 14. Lock tabs 54 and 66 of the frame lock are retracted when actuator 60 is centered (see FIG. 2) and are aligned with slotted openings 17 of frame members 16 and 18. Actuator 60 is then pivoted towards frame member 16 into its lock position by grasping tail 61 of the actuator, causing a lock tab 66 to extend and project into gap 13 within frame member opening 17 between panel 14 and frame member 16 (see FIG. 6). Simultaneously, camming tabs 64 urge slide member 52 vertically into a locked position, causing lock tabs 54 to extend and project into gap 15 within frame member opening 17 between panel 14 and frame member 18 (see FIGS. 3 and 7). To disengage the lock from frame 12, actuator 60 is pivoted away from frame member 16 into its centered position with lock tabs 54 and 66 being retracted and withdrawn from frame members 16, 18. The lock is then lifted from the frame. Frame locks 22, 24 are each generally symetrical about their longitudinal axis to allow the locks to be optionally used in any corner of frame 12. Thus, actuator 60 of each lock may be pivoted towards either side of base 40.

It is to be understood that the scope of the invention is not limited to the above description but may be modified within the scope of the appended claims.

I claim:

1. In a sliding door assembly including a frame having adjoining frame members, a panel member peripherally enclosed by said frame members, means associated with said frame for mounting said door assembly within a door opening for sliding movement over said door opening, the improvement comprising a removable lock associated with said frame for securing two of said adjoining frame members together, said lock including engagement parts overlying and engaging said adjoining frame members at a frame corner to prevent lateral separation of the frame members from the panel member, said lock further including locking tabs and an associated pivotal actuator part shiftable between a lock position in which said locking tabs are extended and a release position in which the locking tabs are retracted, said actuator part being in its lock position with said locking tabs engaging said adjoining frame member to prevent lifting separation of said engagement parts from the adjoining frame members.

2. The door assembly of claim 1 wherein said engagement parts constitute components of a plate member, said actuator part supported by said plate member, one of said locking tabs connected to said actuator part, another of said locking tabs constituting a part of a slide member, contact means between said actuator part and slide member for extending said locking tabs upon shiftable movement of the actuator part into its said lock position and for retracting said locking tabs upon shiftable movement of the actuator part into its said release position.

3. The door assembly of claim 2 wherein said slide member is located between said plate member and said actuator part, said actuator part and slide member contact means including a cam carried by the actuator part and contacting the slide member.

4. The door assembly of claim 2 wherein said engagement parts include protrusions extending outwardly from said plate member, said adjoining frame members having holes therein, said protrusions extending into said frame member holes.

5. The door assembly of claim 2 wherein each frame member includes a slotted opening, said panel member inserted into said slotted opening, said locking tabs fitted between said panel member and said frame members within said slotted openings therein when said actuator part is in its said lock position.

6. The door assembly of claim 2 wherein said mounting means is carried by said plate member.

7. A lock for securing adjoining frame members together about a panel member, said lock comprising a plate member having means for engaging said frame members at a frame corner to prevent lateral separation of the frame members from the panel member, a base part connected to said plate member, an actuator part connected to said base part for pivotal movement between lock and release positions, a slide including a locking tab positioned between said base part and plate member and guided by at least one of the base part and plate member for sliding movement relative to the plate member, said actuator part including a locking tab spaced from said slide locking tab and a cam means contacting said slide for imparting said sliding movement to the slide upon said pivotal movement of the actuator part wherein said plate member and slide locking tabs are shifted into extended positions to engage said frame members to prevent separation of the plate member from the frame members when the actuator part is pivoted into its said lock position and wherein said locking tabs are shifted into retracted positions disengaged from the frame members to allow separation of the plate member from the frame members when the actuator part is pivoted into its said release position.

8. The lock of claim 7 wherein said actuator part includes a second locking tab oppositely located from its first mentioned locking tab, said actuator part having a first and second said lock position depending upon the direction of pivotal movement of the actuator part, wheren said first mentioned actuator part locking tab and said slide locking tab are shifted into said extended positions upon movement of said actuator part into its first said lock position and wherein said second actuator part locking tab and said slide locking tab are shifted into said extended positions upon movement of the actuator part into its second said lock position.

* * * * *